US006412378B1

(12) United States Patent
Borel

(10) Patent No.: US 6,412,378 B1
(45) Date of Patent: Jul. 2, 2002

(54) METHOD OF CUTTING/SCORING ADJACENT FLAT ELEMENTS AND SYSTEM FOR PERFORMING THE METHOD

(75) Inventor: Edouard Borel, Dommartin (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 09/567,258

(22) Filed: May 9, 2000

(30) Foreign Application Priority Data

Jun. 18, 1999 (CH) ..... 1142/99

(51) Int. Cl.[7] ..... B31B 5/18
(52) U.S. Cl. ..... 83/37; 83/55; 83/886
(58) Field of Search ..... 83/37, 55, 880, 83/886, 343, 663

(56) References Cited

U.S. PATENT DOCUMENTS 2,201,184 A * 5/1940 Knowlton ..... 83/663
2,523,153 A * 9/1950 Shapiro ..... 83/343
3,479,931 A * 11/1969 Bishop ..... 493/471
3,800,640 A * 4/1974 Barrie ..... 83/37
3,847,045 A * 11/1974 Willhite, Jr. et al. ..... 83/37
4,429,603 A * 2/1984 Chapman, Jr. et al. ..... 83/37
4,596,546 A * 6/1986 Schellenberg ..... 83/347
4,608,895 A * 9/1986 Bell et al. ..... 83/345
4,785,696 A * 11/1988 Martiny ..... 83/152
4,932,932 A * 6/1990 Schmidt et al. ..... 83/343
6,311,601 B1 * 11/2001 Love ..... 83/863

* cited by examiner

*Primary Examiner*—M. Rachuba
*Assistant Examiner*—Kim Ngoc Tran
(74) *Attorney, Agent, or Firm*—Ostrolenk, Faber, Gerb & Soffen, LLP

(57) ABSTRACT

A cutting/scoring method for at least one row of adjacent flat elements (3*a*, 5*n*) in a material in strip form (1), of which at least one cutting edge (3'–5') or scoring line, transversely of said strip material (1), is straight and extends from one edge of said strip material (1) to the other, consisting in passing said strip material (1) between cutting/scoring cylinders (R1, R2) of a rotary cutting machine. There is created along said cutting edge (3'–5') or said scoring line respectively, extending from one edge of said strip material (1) to the other, at least one offset (k, α) in the direction of transit of said strip material (1) so that said cutting edge (3'–5') or said scoring line respectively does not coincide with the generatrices of said cylinders.

17 Claims, 2 Drawing Sheets

METHOD OF CUTTING/SCORING ADJACENT FLAT ELEMENTS AND SYSTEM FOR PERFORMING THE METHOD

BACKGROUND OF THE INVENTION

1. Field of the Invention

This invention relates, to a method of cutting/scoring at least one row of adjacent flat elements in a strip of material, by passing the strip between cutting/scoring cylinders of a rotary cutting machine. In particular, the invention relates to a method for solving problems which arise when at least one cutting edge or scoring line extends transversely in a straight line from one edge of the strip to the other. The invention also relates to a system for performing the method.

2. Related Art

One particular application of this invention is in the manufacture of folding boxes by the cutting and/or scoring strips of cardboard material between two cylinders, one of which carries one or more fillets that serve as cutting or scoring elements. A known problem in such an operation is that impact of the cutting or scoring fillet as the cylinders rotate generates an essentially vertical vibration which results in very slight modifications in the geometry around the cutting fillet. These modifications of the space between the cutting fillet and the adjacent cylinder, although only of the order of a few $\mu$m, are sufficient to affect the quality of the cut, leaving a certain proportion of fibres uncut. The longer the cutting fillet in the direction of the cutting cylinder generatrices, the greater the impact and it becomes a maximum when the cutting fillet covers the entire width of the strip material, something which is very often the case.

These cutting impacts also constitute a considerable source of noise and are repeated high frequency.

SUMMARY OF THE INVENTION

The object of this invention is to reduce the magnitude of these impacts in order to reduce the consequences affecting the cutting quality and noise.

According to the invention, it has been found that this object can be attained by introducing slight offsets between the adjacent transverse edges or very small angles with the generatrices of the cutting cylinders. Only slight offsets are needed to give a very substantial reduction of the effects of impacts. Thus what is involved is a very simply applied operational step, but one which allows a substantial improvement to be made to the above problems.

BRIEF DESCRIPTION OF THE DRAWINGS

The invention will be more readily understood from the following description and the accompanying drawings which diagrammatically illustrate by way of example the results of various embodiments of the cutting/scoring method according to the invention.

FIG. 1 shows schematically, the cutting/scoring operation to which the invention pertains. Here, a segment of a strip 1 of a material such as cardboard used for the production of folding boxes passes between two cutting and/or grooving cylinders R1, R2 of a rotary cutting machine of known type, in the transit direction indicated by arrow 2. The required shape is produced by cutting around the periphery of the box and scoring at the fold lines. Cylinder R1 is shown with a transverse cutting fillet F.

FIG. 7 shows a strip cut according to conventional practice, and FIG. 8 shows a side elevation of a roll for producing the strip shown in FIG. 7.

In this example, three rows of flat elements 3A, 4A, and 5A respectively are disposed parallel to the transit axis of a strip 1A through the roll assembly. Each element 3*a*–3*n*, 4*a*–4*n*, 5*a*–5*n* of the three rows is denoted symbolically by a simple rectangle. Obviously the actual shape of these elements is generally substantially more complex, each box being formed by a number of panels separated by fold lines, but the exact form is unimportant to an understanding of the principle of the invention. It is sufficient to know that the elements of the rows 3A, 4A and 5A have straight cut edges 3B, 4B, and 5B respectively, which extend in straight lines in a direction substantially transverse to the transit axis 2 (see FIG. 1) of the strip 1A from which they are cut. Also, as illustrated, the rows of elements 3A, 4A and 5*a* are separated from each other by cut edges 3C and 4C which extend lengthwise, i.e., in the transit direction 2.

Figure 7:
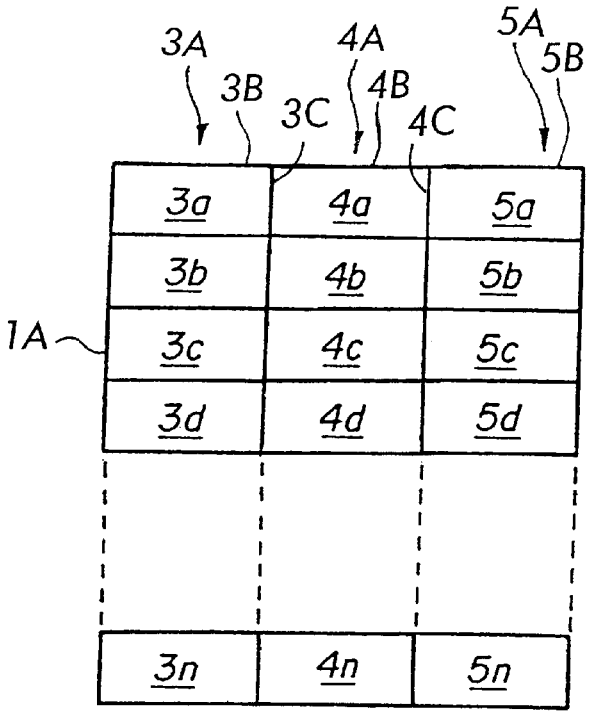
FIG. 7 PRIOR ART
FIG. 7 is a plan view of a strip cut and/or scored according to conventional practice.
Figure 8:
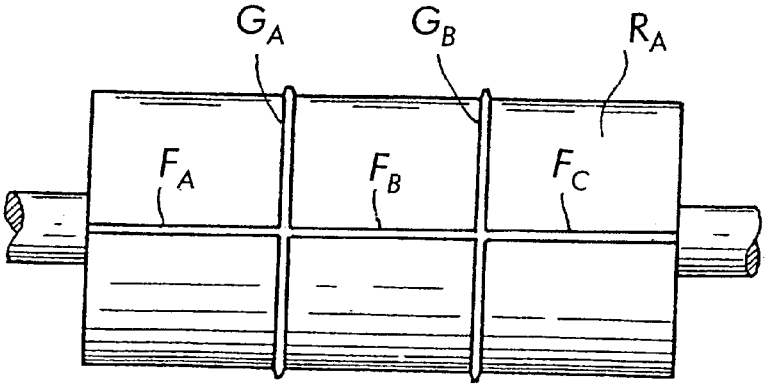
FIG. 8 PRIOR ART
FIG. 8 is a schematic illustration of a cutting cylinder according to conventional practice.

A strip according to FIG. 7 is formed by a cutting cylinder $R_A$ shown in FIG. 8. Here an arrangement of cutting fillets $F_A$, $F_B$, and $F_C$ aligned with a generatrix of the cutting cylinder $R_A$ produces the three aligned rows of cut elements across the strip. Two circumferential fillets $G_A$ and $G_B$ produce respective cuts 3C and 4C along the length of the strip.

Figure 1:
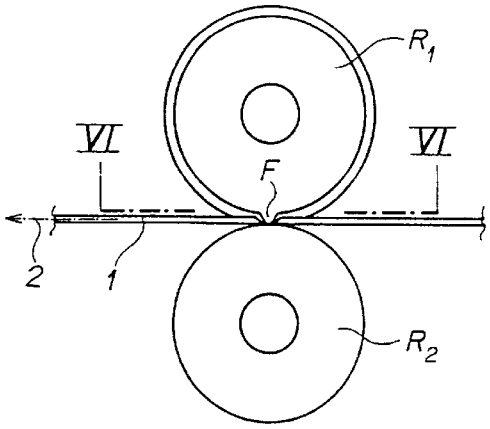
FIG. 1 is a schematic side elevation of a rotary cutting machine.
Figure 2:
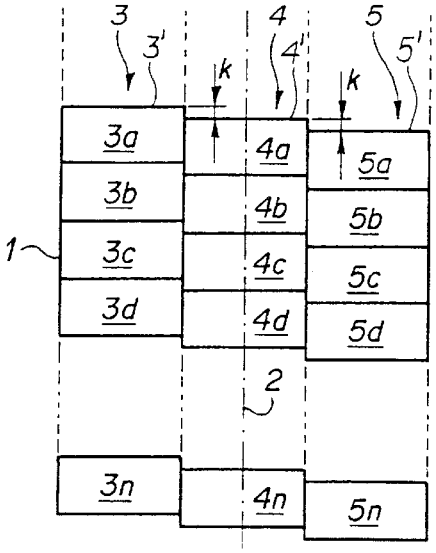
FIGS. 2 to 5 are plan views of four segments of strips of material which have been cut and/or scored, in different arrangements according to several embodiments of the invention.

Several of embodiments of strips produced according to the method of the invention are shown in FIGS. 2–5. In the embodiment of FIG. 2, three rows of flat elements 3, 4, 5 respectively are disposed parallel to the transit axis 2 (FIG. 1). Again, each element 3*a*–3*n*, 4*a*–4*n*, 5*a*–5*n* of the three rows is denoted symbolically by a simple rectangle to represent the actual shape. In practice, the elements of the rows 3, 4 and 5 have straight cutting edges 3', 4', 5' respectively, which extend in a substantially transverse direction to the transit axis 2 of the strip 1 from which they are cut.

When the adjacent cutting edges 3', 4' and 5' are aligned and extend perpendicularly, from one edge to the other of the strip 1 of material for cutting, they coincide with the generatrices of the cylinders $R_1$, $R_2$.

According to the method of the present invention, and as illustrated in FIG. 2, the cutting fillets F are arranged on the cylinder R so that the adjacent cutting edges 3', 4' and 5' are offset in the longitudinal direction of the strip 1 by a distance k so as not to coincide with the generatrices of the cylinders $R_1$, $R_2$ over the entire width of the strip 1. This offset arrangement of the cutting lines 3', 4' and 5' enables the magnitude of each impact of the cutting fillets F to be reduced, by dephasing them relatively to one another. The value of the distance k between two adjacent cutting lines 3', 4' or 4', 5' can be very small. Even an offset of the order of 1 millimetre, for example, is effective. The method reflected by the product illustrated in FIG. 2 is implemented by placement of fillets which are offset along the length of roll R1 so as not to coincide with a single generatrix thereof. The difference from conventional practice may be seen from comparison of FIGS. 6 and 8.

Figure 3:
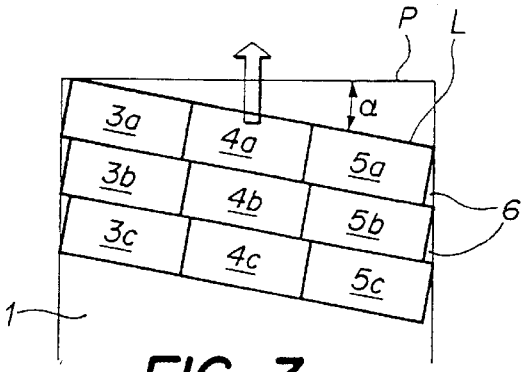

According to a second variant illustrated in FIG. 3, the cutting fillets F are arranged on the cylinder R1 so that the adjacent cutting lines 3', 4' and 5' are on a single line L slanted with respect to the generatrix of cylinder $R_1$. Thus, the offset between this line L and the generatrices of the cylinders $R_1$, $R_2$ is obtained by providing an angle between line L and a perpendicular P to the transit axis 2 of the strip 1. The cutting of line L is effected progressively as if by a pair of scissors. A small angle is sufficient to be effective. In this variant, waste of triangular shape 6 is generated between the longitudinal edges of the strip 1 and the adjacent edges of the elements 3*a*–3*n*, respectively of the elements 5*a*–5*n*, of the two rows 3 and 5 adjacent the longitudinal edges of the strip 1.

Figure 4:
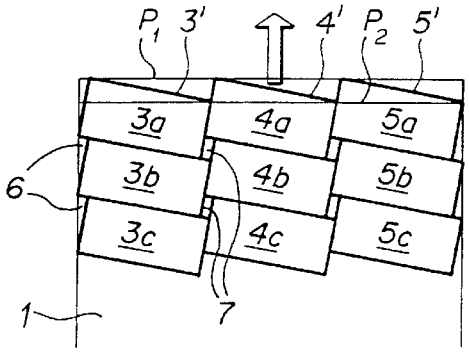

In the third variant illustrated in FIG. 4, cutting fillets F are arranged on the cylinder $R_1$ so that the three homologous transverse cut edges 3', 4' and 5' of the adjacent elements 3*a*–3*n*, 4*a*–4*n*, 5*a*–5*n* of the three rows 3, 4 and 5 have their respective ends aligned along two perpendiculars $P_1$, $P_2$ to the transit axis of the strip 1, each cutting edge forming the same angle with both perpendiculars $P_1$, $P_2$ Thus, the cut elements in rows 3', 4' and 5' are both angled and longitudinally offset. This arrangement of the elements 3*a*–3*n*, 4*a*–4*n*, 5*a*–5*n*, in addition to producing triangular waste 6 along the two edges of the strip 1, produces rectangular waste 7 inside strip 1.

The first variant does not produce any waste either on the edges or in the inside of the strip 1. The other two variants produce very small waste. In all these variants, one and the same transverse cutting lines 3', 4', 5' serves to separate two adjacent elements so that no waste is produced between the adjacent elements.

Depending on the type of element for cutting, i.e. depending on the type of box and the extent to which a certain percentage of waste is acceptable between transverse cutting edges, i.e. a double cut is made, it is possible to devise numerous distributions of fillets F on cylinder $R_1$ in which the transverse cutting lines are slanted or not slanted.

Figure 5:
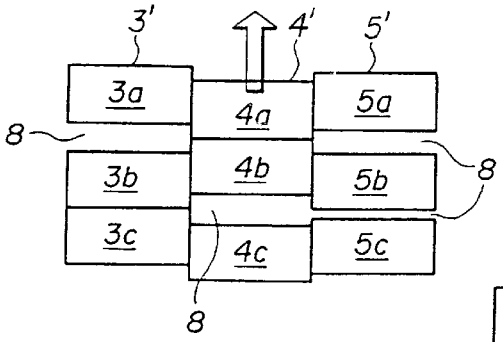

FIG. 5 shows the result obtained according to one of the possible arrangements, in which the transverse cutting lines 3', 4', 5' are not slanted. Obviously, the arrangement of this type can vary in practice infinitely depending on the shape of the elements 3*a*–3*n*, 4*a*–4*n*, 5*a*–5*n* which, as we have said, is in actual fact more complex than the simple rectangular shape representing these elements diagrammatically. Thus it is possible to obtain the association of cut-out elements with a single-cut cutting edge and the double-cut parallel edges forming parallel-edge waste 8 between them, as shown in FIG. 5. The only condition to be met with this procedure is to avoid having a transverse cutting line over the entire width of the strip 1.

Although the foregoing examples refer to cutting lines, the same is applicable to the scoring lines which serve for the folding of the various panels and flaps forming the folding boxes. It will therefore be understood that wherever applicable, reference to cutting is intended to include scoring, there being no difference for purposes of the invention between cutting and scoring.

If the cut-out elements 3*a*–3*n*, 4*a*–4*n*, 5*a*–5*n* are inclined with respect to the transit axis 2 of the strip 1, as in the variants shown in FIGS. 3 and 4, the impression formed on these elements will of course have the same inclination so that it is inclined to the edges of the panels of the box.

Figure 6:
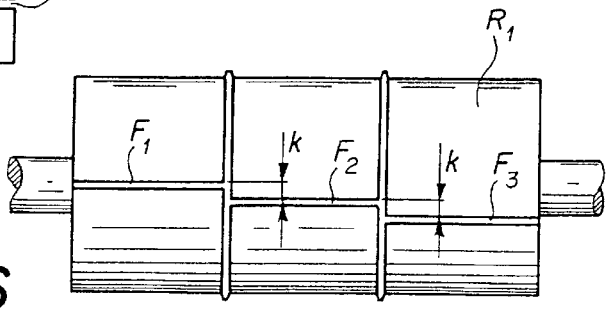
FIG. 6 is a front elevation that illustrates schematically the surface of a cutting cylinder for performing the method according to the invention.

FIG. 6 shows the cutting cylinder $R_1$ for practicing the method of the invention in the context of the first embodiment shown in FIG. 2. The arrangement of the cutting fillets $F_1$, $F_2$, $F_3$ obviously corresponds to that of the transverse cutting lines 3', 4' and 5' formed on the strip material 1. Thus in this embodiment each fillet $F_1$, $F_2$, $F_3$ is offset by a value k with respect to the corresponding generatrix of the cutting cylinder $R_1$.

As will be readily understood by those skilled in the art, the orientations of the end to end and peripheral fillets on the cutting cylinder are selected to produce the desired configuration of cut or scored elements on the strip.

Although the present invention has been described in relation to particular embodiments thereof, many other variations and modifications and other uses will become apparent to those skilled in the art. It is intended, therefore, that the present invention be limited not by the specific disclosure herein, but only by the appended claims.

What is claimed is:

1. A rotary cutting machine for forming a plurality of rows of adjacent flat elements extending longitudinally along a strip of material and spaced along the strip, comprising:

first and second cylinders driven in opposite directions, and spaced to form a nip for engaging the strip, one of the cylinders having thereon a fillet structure including:

a plurality of first fillets extending peripherally on, and axially spaced along, the one cylinder, the first fillets being operative to form edges between elements in adjacent rows across the strip; and a plurality of second fillets extending in an end-to-end direction on the one cylinder, the second fillets being operative to form transversely extending edges of the elements in adjacent rows;

adjacent ones of the second fillets being offset in a direction of transit of the strip material between the cylinders so as not to coincide with a single generatrix of the one cylinder.

2. Apparatus according to claim 1, wherein the offset adjacent second fillets are parallel to one another.

3. Apparatus according to claim 1, wherein:

each of the first fillets extends circumferentially on the one cylinder; and each of second fillets extends axially on the one cylinder.

4. Apparatus according to claim 1, wherein:

the offset adjacent second fillets lie on a straight line forming an acute angle with a line perpendicular to the direction of transit of the strip between the cylinders.

5. Apparatus according to claim 1, wherein:

one end of each of the offset adjacent second fillets lies on a first straight line forming an acute angle with a line perpendicular to the direction of transit of the strip material between the cylinders; and the respective opposite ends of each of the second fillets lie on a second straight line forming an acute angle with a line perpendicular to the direction of transit of the strip material between the cylinders, the first and second straight lines being spaced from each other in the direction of transit.

6. Apparatus according to claim 1, wherein the second fillets are positioned so that waste is created between adjacent elements in at least one row.

7. A method for forming a plurality of rows of adjacent flat elements extending longitudinally along a strip of material, and spaced across the strip, the method comprising:

longitudinally passing the strip between two opposed cylinders of a rotary cutting machine, one of the cylinders having thereon a fillet structure including:

a plurality of first fillets extending peripherally on the one cylinder which form edges between adjacent rows across the strip; and a plurality of second fillets extending in an end-to-end direction, which form element edges extending generally transversely of the strip;

adjacent ones of the second fillets being offset in a direction of transit of the strip material between the cylinders so as not to coincide with a single generatrix of the cylinder; and engaging one surface of the strip with the fillet structure on the one cylinder while engaging an opposite surface of the strip with the other cylinder.

8. A method according to claim 7, wherein the second fillets are positioned so that waste is created between adjacent elements in at least one row.

9. A method according to claim 7, wherein the offset adjacent second fillets are parallel to one another.

10. A method according to claim 7, wherein:

each of the first fillets extends circumferentially on the one cylinder; and each of second fillets extends axially on the one cylinder.

11. A method according to claim 7, wherein:

the offset adjacent second fillets lie on a straight line forming an acute angle with a line perpendicular to the direction of transit of the strip between the cylinders.

12. A method according to claim 7, wherein:

one end of each of the offset adjacent second fillets lies on a first straight line forming an acute angle with a line perpendicular to the direction of transit of the strip material between the cylinders; and the respective opposite ends of each of the second fillets lie on a second straight line forming an acute angle with a line perpendicular to the direction of transit of the strip material between the cylinders, the first and second straight lines being spaced from each other in the direction of transit.

13. A method for forming at least one row of adjacent flat elements from a strip of material, the method comprising:

passing the strip of material between two opposed cylinders of a rotary cutting machine, one of the cylinders having thereon a fillet structure including:

a plurality of peripherally extending first fillets which form element edges spaced transversely across the strip; and a plurality of second fillets extending in an end-to-end direction along the cylinder which form element edges extending generally transversely of the strip;

adjacent ones of the second fillets being offset in a direction of transit of the strip between the cylinders so as not to coincide with a single generatrix of the cylinder; and engaging one surface of the strip with the fillet structure on the one cylinder while engaging an opposite surface of the strip with the other cylinder.

14. A method according to claim 13, wherein the offset adjacent second fillets are parallel to one another.

15. A method according to claim 13, wherein:

each of the first fillets extends circumnferentially on the one cylinder; and each of second fillets extends axially on the one cylinder.

16. A method according to claim 13, wherein:

the offset adjacent second fillets lie on a straight line forming an acute angle with a line perpendicular to the direction of transit of the strip between the cylinders.

17. A method according to claim 13, wherein:

one end of each of the offset adjacent second fillets lies on a first straight line forming an acute angle with a line perpendicular to the direction of transit of the strip material between the cylinders; and the respective opposite ends of each of the second fillets lie on a second straight line forming an acute angle with a line perpendicular to the direction of transit of the strip material between the cylinders, the first and second straight lines being spaced from each other in the direction of transit.

* * * * *